US006816027B2

(12) United States Patent
Hasegawa

(10) Patent No.: US 6,816,027 B2
(45) Date of Patent: Nov. 9, 2004

(54) THREE-PORT NONRECIPROCAL CIRCUIT DEVICE AND COMMUNICATION APPARATUS

(75) Inventor: Takashi Hasegawa, Mattou (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 10/637,633

(22) Filed: Aug. 11, 2003

(65) Prior Publication Data

US 2004/0032306 A1 Feb. 19, 2004

(30) Foreign Application Priority Data

Aug. 14, 2002 (JP) ..... 2002-236649

(51) Int. Cl.[7] ..... H01P 1/36
(52) U.S. Cl. ..... 333/24.2; 333/1.1
(58) Field of Search ..... 333/1.1, 24.2

(56) References Cited

U.S. PATENT DOCUMENTS 6,215,371 B1 * 4/2001 Kurahashi et al. ..... 333/1.1

FOREIGN PATENT DOCUMENTS

| | | | |
|---|---|---|---|
| FR | 002671912 | A1 * | 7/1992 |
| JP | 2001-185912 | | 7/2001 |
| JP | 2001-237613 | | 8/2001 |
| JP | 2001-320205 | | 11/2001 |
| JP | 2001-320206 | | 11/2001 |

* cited by examiner

*Primary Examiner*—Stephen E. Jones
(74) *Attorney, Agent, or Firm*—Keating & Bennett, LLP

(57) ABSTRACT

A three-port nonreciprocal circuit device has a structure in which one end of a first center electrode is electrically connected to an input external terminal via an input port, and the other end thereof is electrically connected to a ground external terminal. One end of a second center electrode is electrically connected to an output external terminal via an output port. The second center electrode and a matching capacitor constitute an LC parallel resonator circuit. A series inductor is electrically connected between the LC parallel resonator circuit and the ground external terminal. One end of a circuit center electrode is electrically connected to a third port. A matching capacitor and a terminating resistor constitute a parallel RC circuit, which is electrically connected between the third port and ground.

9 Claims, 16 Drawing Sheets

THREE-PORT NONRECIPROCAL CIRCUIT DEVICE AND COMMUNICATION APPARATUS

BACKGROUND OF THE INVENTION

1. Field of the Invention

The present invention generally relates to three-port nonreciprocal circuit devices, and more particularly, relates to a three-port nonreciprocal circuit device, such as an isolator or circulator, used in a microwave band, and also relates to a communication apparatus including the nonreciprocal circuit device.

2. Description of the Related Art

Typically, isolators operate so as to allow signals to pass only in the transmission direction and to block the transmission in the opposite direction, and are used in transmission circuit sections of mobile communication apparatuses, such as car phones and portable telephones.

Conventionally, as isolators of this type, three-port isolators (isolators having three, i.e., first to third, center electrodes) have been known. As shown in FIG. 12, an isolator 100 includes center electrodes 101, 102, and 103, a ferrite element 110, matching capacitors 105, 106, and 107, and a terminating resistor 108. A port portion P1 is connected to one end of the center electrode 101. An input terminal 114 and the matching capacitor 105 are electrically connected to the port portion P1. A port portion P2 is connected to one end of the center electrode 102. An output terminal 115 and the matching capacitor 106 are electrically connected to the port portion P2. A port portion P3 is connected to one end of the center electrode 103. The matching capacitor 107 and the terminating resistor 108 are electrically connected to the port portion P3. The matching capacitors 105, 106, and 107 and the terminating resistor 108 are connected to corresponding ground.

Meanwhile, in typical communication apparatuses, amplifiers used in the circuits thereof cause signals to be distorted to some extent. This distortion causes spurious components, such as a second harmonic (2 f) and a third harmonic (3 f) of an operating frequency f, to be generated, which is responsible for unwanted emissions. Since unwanted emissions in communication apparatuses causes malfunction and/or interference of power amplifiers, standards and specifications are specified in advance. In order to prevent unwanted emissions, a method in which a filter or the like is provided is commonly used to attenuate unwanted frequency components. The use of such a filter, however, leads to a problem in that loss occurs because of the filter, which is undesirable.

Accordingly, a possible approach for suppressing spurious components is to utilize characteristics of bandpass filters included in the isolators or circulators. However, the nonreciprocal circuit device having the basic conventional configuration shown in FIG. 12 cannot provide sufficient attenuation characteristics in an unwanted frequency band.

To overcome the problem, Japanese Unexamined Patent Application Publication Nos. 2001-320205 and 2001-320206 disclose nonreciprocal circuit devices that can provide large attenuation in, mainly, a frequency band in which spurious components, such as a second harmonic (2 f) and a third harmonic (3 f) of an operating frequency (f), are generated. FIG. 13 is an equivalent circuit diagram of an isolator that is one example of the nonreciprocal circuit devices of the related art.

This isolator 120 is different from the isolator 100 shown in FIG. 12 in that a series inductor 121 is electrically connected between the matching capacitor 106 and ground. Thus, the matching capacitor 106 and the series inductor 121 constitute a trap circuit, which makes it possible to attenuate signals in a frequency band away from the passband.

FIG. 14 is a graph showing the attenuation characteristics of the isolator 100 (Conventional Example 1) shown in FIG. 12 and the isolator 120 (Conventional Example 2) shown in FIG. 13. Both of the isolators 100 and 120 have a bandpass of 900 MHz. From FIG. 14, it can be seen that Conventional Example 2 displays increased attenuations of a second harmonic (2 f) and a third harmonic (3 f) compared to Conventional Example 1.

As discussed in Japanese Unexamined Patent Application Publication No. 2001-320205, one end of each of the three center electrodes 101, 102, and 103 in the isolator 120 is electrically connected to a common ground portion having the same shape as the bottom surface of the ferrite element 110. This common ground portion is brought into contact with the bottom surface of the ferrite element 110. The three center electrodes 101, 102, and 103 extending from the common ground portion are bent so as to be spaced 120 degrees with respect to one another and are arranged on the upper surface of the ferrite element 110 with an insulating sheet interposed therebetween.

However, while the isolator 120 having the trap circuit, which is constituted by the matching circuit 106 and the series inductor 121, as shown in FIG. 13, can increase the attenuations of the second harmonic (2 f) and the third harmonic (3 f) of the operating frequency of a communication apparatus, there are problems in that the insertion loss and return loss characteristics deteriorate and the band width ratio decreases.

FIG. 15 is a graph showing the insertion loss characteristics of the isolator 100 (conventional example 1) shown in FIG. 12 and the isolator 120 (conventional example 2) shown in FIG. 13, and FIG. 16 is a graph showing the output return-loss characteristics thereof. From FIGS. 15 and 16, it can be seen that the band width ratio of the isolator 120 decreases.

SUMMARY OF THE INVENTION

In order to overcome the problems described above, preferred embodiments of the present invention provide a three-port nonreciprocal circuit device and a communication apparatus which prevent the propagation of a second harmonic (2 f) and a third harmonic (3 f) of an operating frequency f without deterioration of the insertion loss and return loss characteristics.

A three-port nonreciprocal circuit device according to a preferred embodiment of the present invention includes:

(a) a ferrite element;

(b) a permanent magnet for applying a direct-current magnetic field to the ferrite element;

(c) a first center electrode arranged at a major surface of the ferrite element or in the ferrite element, one end of the first center electrode being electrically connected to a first port;

(d) a second center electrode arranged at the major surface of the ferrite element or in the ferrite element so as to cross the first center electrode in an electrically insulating state, one end of the second center electrode being electrically connected to a second port;

(e) a third center electrode arranged at the major surface of the ferrite element or in the ferrite element so as to cross the first center electrode and the second center electrode in an electrically insulating state, one end of the third center electrode being electrically connected to a third port;

(f) at least one matching capacitor constituting an LC parallel resonator circuit in conjunction with one of the first, second, and third center electrodes, and (g) at least one series inductor electrically connected between one of the at least one LC parallel resonator and ground.

In addition, the three-port nonreciprocal circuit device is preferably constructed such that the other end of at least one of the first, second, and third center electrodes is not connected to a common potential and does share a common end with another end.

With the arrangement described above, a circuit in which each LC parallel resonator circuit, constituted by the center electrode and the matching capacitor, and the corresponding series inductor are connected provides a trap circuit. This trap circuit can increase the attenuations of the second harmonic (2 f) and the third harmonic (3 f) of the operating frequency f of a communication apparatus without deterioration of the insertion loss and return loss characteristics. The resonant frequency (trap frequency) of the trap circuit, constituted by the LC parallel resonator circuit and the series inductor, is preferably in the range of about 1.5 to about 3.5 times the operating frequency.

The inductances of the series inductors, each electrically connected between the corresponding LC parallel resonator circuit and ground, may be different from each other. In this case, the trap frequencies of the trap circuits can be made different from each other. Thus, for example, setting the trap frequency of one trap circuit to be in the vicinity of the second harmonic (2 f) and setting the trap frequency of another trap circuit to be in the vicinity of the third harmonic (3 f) can further increase the attention of both the second harmonic (2 f) and the third harmonic (3 f).

The at least one matching capacitor preferably includes a capacitor electrode and the at least one series inductor includes an inductor electrode. The capacitor electrode and the inductor electrode may be provided in a multilayer substrate in which insulating layers are stacked. This can reduce the number of connections soldered between the matching capacitor and the series inductor and can increase connection reliability.

A communication apparatus according to-another preferred embodiment of the present invention includes the three-port nonreciprocal circuit device described above. This communication apparatus, therefore, can improve frequency characteristics.

Accordingly, the present invention can provide a three-port nonreciprocal circuit element and a communication apparatus which are improved in performance and reliability and are reduced in size.

Other features, elements, characteristics and advantages of the present invention will become more apparent from the following detailed description of preferred embodiments thereof with reference to the attached figures.

DETAILED DESCRIPTION OF PREFERRED EMBODIMENTS

First Preferred Embodiment

Figure 1:
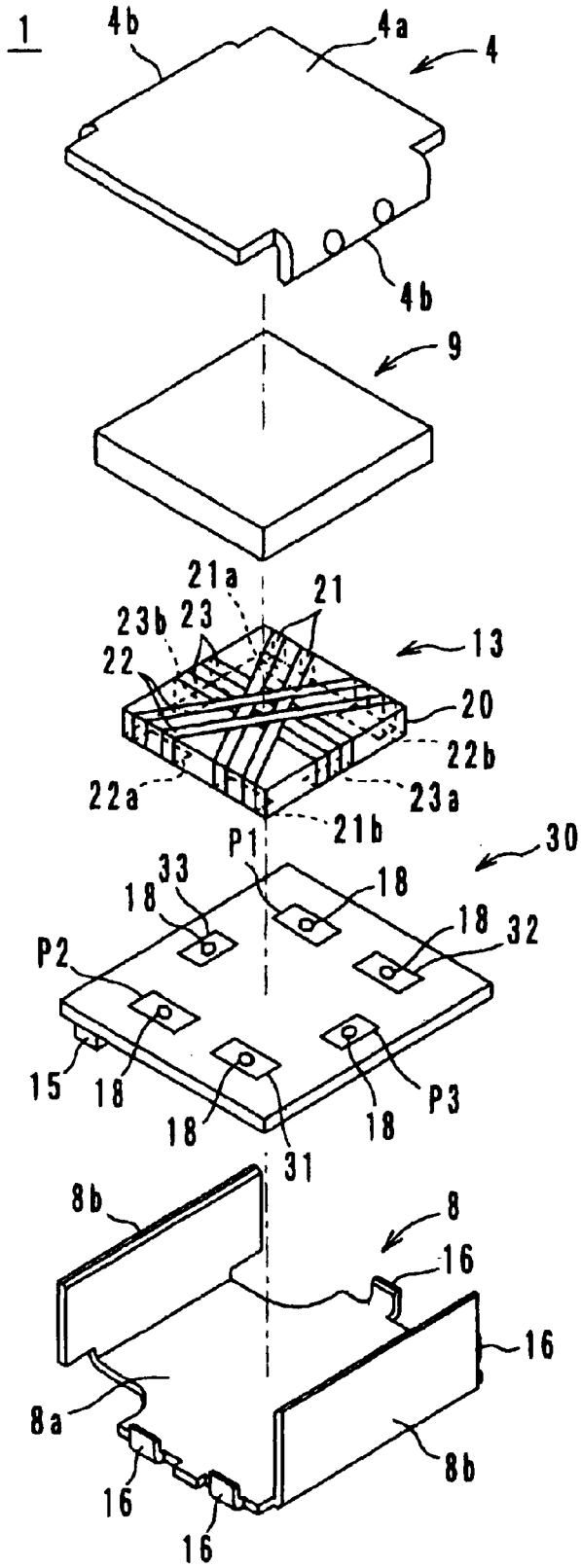
FIG. 1 is an exploded perspective view of a three-port isolator according to a first preferred embodiment of the present invention.

A first preferred embodiment of the present invention will now be described with reference to FIGS. 1 to 8. FIG. 1 is an exploded perspective view of a three-port nonreciprocal circuit device 1 according to a first preferred embodiment of the present invention. This three-port nonreciprocal circuit device 1 operates as a lumped-element isolator. As shown in FIG. 1, the three-port isolator 1 preferably generally includes a metal casing constituted by an upper metal casing 4 and a lower metal casing 8, a permanent magnet 9, a center-electrode assembly 13 having a substantially rectangular microwave ferrite element 20 and three sets of center electrodes 21 to 23, and a multilayer substrate 30.

The upper metal casing 4 has a top portion 4*a* and two lateral portions 4*b*. The lower metal casing 8 has a bottom portion 8*a* and two lateral portions 8*b*. Ground external terminals 16 are provided at the bottom portion 8*a*. Since the upper metal casing 4 and the lower metal casing 8 define a magnetic circuit, they are formed of material made of, for example, ferromagnetic material, such as soft iron, and the surfaces thereof are plated with Ag or Cu.

The center-electrode assembly 13 is configured such that the center electrodes 21 to 23 are arranged at the upper surface of the ferrite element 20 so as to cross one another at angles of substantially 120 degrees with an insulating layer (not shown) interposed therebetween. In the first preferred embodiment, each set of the center electrodes 21 to 23 is preferably constituted by two lines. Ends 21*a*, 21*b*, 22*a*, 22*b*, 23*a*, and 23*b* of the center electrodes 21 to 23 extend to the lower surface of the ferrite element 20 and are separated from one another.

The center electrodes 21 to 23 may be wound around the ferrite element 20 by using copper films or may be formed by printing a silver paste on or in the ferrite element 20. Alternatively, the center electrodes 21 to 23 may be formed with a multilayer substrate as in Japanese Unexamined Patent Application Publication No. 9-232818. However, printing the center electrodes 21 to 23 provides a higher positional accuracy of the center electrodes 21 to 23, so that the connection with the multilayer substrate 30 is stabilized. In particular, when the center electrodes 21 to 23 and the multilayer substrate 30 are interconnected using micro center-electrode connecting electrodes 31 to 33 (described below) as in this case, the formation of the center electrodes 21 to 23 by printing can improve the reliability and workability.

Figure 2:
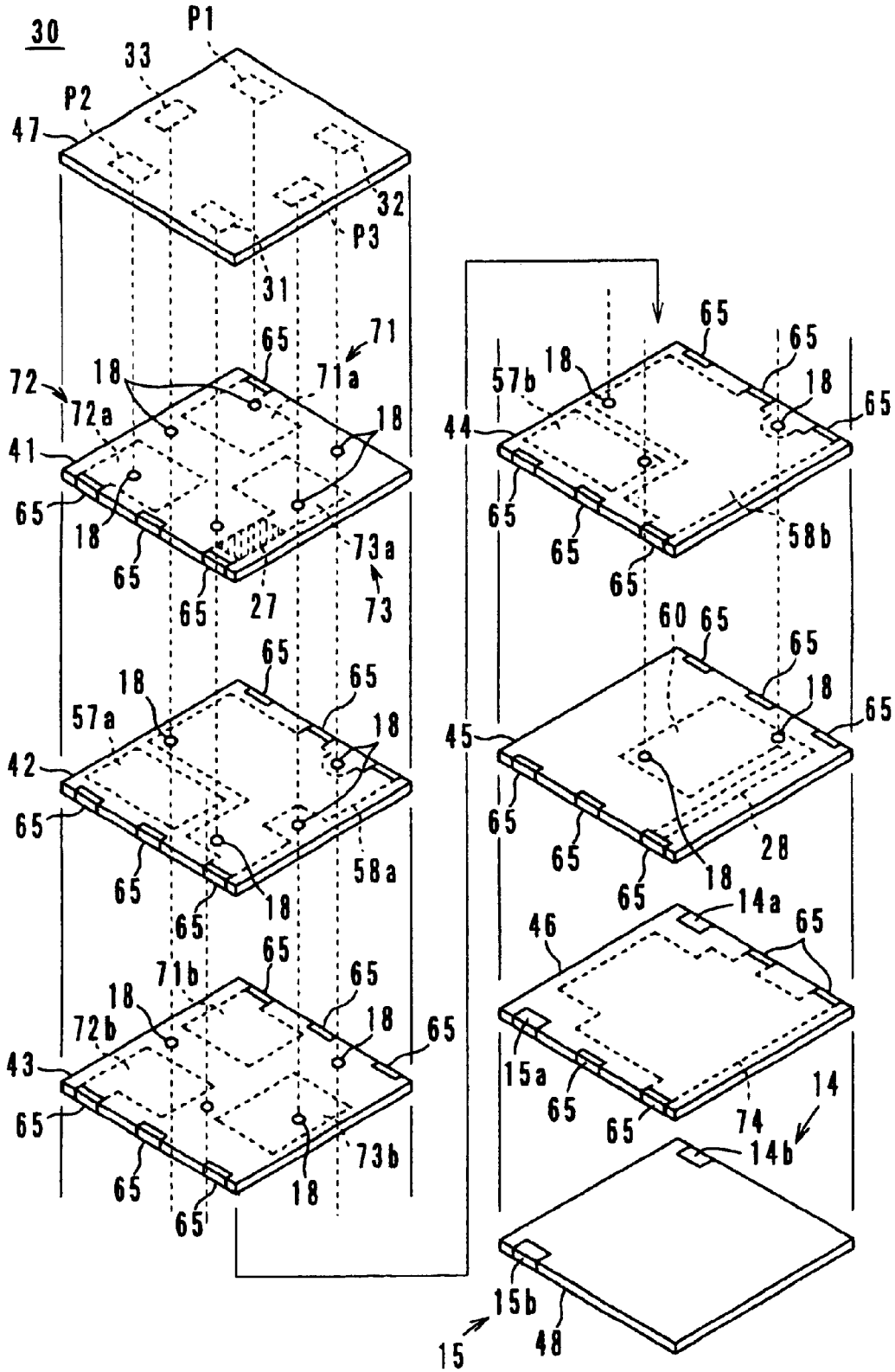
FIG. 2 is an exploded perspective view of the multilayer substrate shown in FIG. 1.

As shown in FIG. 2, the multilayer substrate 30 preferably includes a shrink-restraining sheet 47, dielectric sheets 41 to 46, and a shrink-restraining sheet 48. The shrink-restraining sheet 47 has, at the bottom surface, an input port P1, an output port P2, a third port P3, and center-electrode connecting electrodes 31 to 33. The dielectric sheet 41 has, at the bottom surface, hot-side capacitor electrodes 71*a* to 73*a*, a terminating resistor 27, and other suitable elements. The dielectric sheet 42 has, at the bottom surface, ground-side capacitor electrodes 57*a* and 58*b*. The dielectric sheet 43 has, at the bottom surface, hot-side capacitor electrodes 71*b*, 72*b*, and 73*b*. The dielectric sheet 44 has, at the bottom surface, ground-side capacitor electrodes 57*b* and 58*b*. The dielectric sheet 45 has, at the bottom surface, an inductor electrode (a series inductor) 28 and a relay electrode 60. The dielectric sheet 46 has a ground electrode 74, an input-external-terminal via hole 14*a*, and an output-external-terminal via hole 15*a*. The shrink-restraining sheet 48 has an input-external-terminal via hole 14*b* and an output-external-terminal via hole 15*b*.

This multilayer substrate 30 is preferably fabricated as follows. The dielectric sheets 41 to 46 are made of dielectric material that sinters at a low temperature. The dielectric material includes $Al_2O_3$ as the main component and includes one or more types of $SiO_2$, SrO, CaO, PbO, $Na_2O$, $K_2O$, MgO, BaO, $CeO_2$, and $B_2O_3$ as a sub-component.

In addition, the shrink-restraining sheets 47 and 48, which do not sinter under the firing conditions (especially, at a firing temperature of about 1000° C. or less) of the multilayer substrate, are formed to restrain firing shrinkage of the multilayer substrate 30 in the plane direction (the X-Y direction) thereof. Material for the shrink-restraining sheets 47 and 48 is preferably a mixed material of alumina power and stabilized zirconia power. The sheets 41 to 48 have a thickness of about 10 μm to about 200 μm.

The electrodes 28, 57*a*, 57*b*, 58*a*, 58*b*, 71*a*, 72*a*, 73*a*, 71*b*, 72*b*, 73*b*, and 74 are formed at the back surfaces of the sheets 41 to 46 by, for example, a method for printing patterns. Ag, Cu, or Ag—Pd that has low resistivity and that can be fired concurrently with the dielectric sheets 41 to 46 is used as material for the electrodes 28, 71*a*, 72*a*, 73*a*, 71*b*, 72*b*, and 73*b*. Each of the electrodes 28, 71*a*, 72*a*, 73*a*, 71*b*, 72*b*, 73*b*, and the like have a thickness of about 2 μm to about 20 μm, and is typically about two or more times the thickness of the skin layer.

The terminating resistor 27 is formed at the back surface of the dielectric sheet 41 by, for example, a method for printing patterns. Cermet, carbon, ruthenium, or other suitable material is preferably used as material for the terminating resistor 27. The terminating resistor 27 may be formed at the upper surface of the multilayer substrate 30 by printing or may be formed as a chip resistor.

Via holes 18, side-surface via holes 65, and external-terminal via holes 14*a*, 14*b*, 15*a*, and 15*b* are formed in such a manner that holes for the via holes are formed in the dielectric sheets 41 to 46 and the shrink-restraining sheet 48 by laser processing, punching, or other suitable process, and then are filled with a conductive paste.

The capacitor electrodes 71*a*, 72*a*, 73*a* and the capacitor electrodes 71*b*, 72*b*, 73*b* oppose the capacitor electrodes 57*a*, 57*b*, 58*a*, and 58*b* and constitute the matching capacitors 71, 72, and 73 with the dielectric sheets 42 to 44 interposed therebetween. These matching capacitors 71 to 73, the terminating resistor 27, and the inductor 28 constitute an electrical circuit within the multilayer substrate 30 in conjunction with the ports P1 to P3, the via holes 14*a*, 14*b*, 15*a*, 15*b*, 18, 65, and the like.

The dielectric sheets 41 to 46 are stacked and are further sandwiched by the shrink-restraining sheets 47 and 48 from both upper and lower sides of the stack of the dielectric sheets 41 and 46, and then the resulting structure is fired. As a result, a laminate is provided. Thereafter, unsintered shrink-restraining material is removed by supersonic cleaning or wet honing to provide the multilayer substrate 30 as shown in FIG. 1.

The input-external-terminal via holes 14*a* and 14*b* are integrated together into an input external terminal 14 and the output-external-terminal via holes 15*a* and 15*b* are integrated together into an output external terminal 15. Thus, the multilayer substrate 30 has, at the bottom surface, a protruding input external terminal 14 and a protruding output external terminal 15. Then, the input external terminal 14 is electrically connected to the capacitor electrodes 71*a* and 71*b*, and the output external terminal 15 is electrically connected to the capacitor electrodes 72*a* and 72*b*. Thereafter, the multilayer substrate 30 is plated with Au by using Ni plating as an undercoat. The Ni plating increases the bonding strength between the Ag of the electrodes and the Au plating. The Au plating can improve the solder wettability, and can reduce the loss of the isolator 1 because of its high electrical conductivity.

A plurality of multilayer substrates 30 is typically fabricated in a motherboard state. Precut grooves are formed in the motherboard at a predetermined pitch and the motherboard is bent and divided along the precut grooves into the multilayer substrates 30 having a desired size. Alternatively, the motherboard may be diced by a dicer or a laser to be cut into the multilayer substrates 30 having a desired size.

The multilayer substrates 30 formed in this manner each have therein the matching capacitors 71 to 73, the terminating resistor 27, and the inductor 28. The matching capacitors 71 to 73 are made according to a required capacitance accuracy. However, when trimming is performed, it is performed before the matching capacitors 71 to 73 and the center electrodes 21 to 23 are connected. That is, the capacitor electrodes 71*a*, 72*a*, and 73*a* inside (i.e., at the second layer of) each multilayer substrate 30, together with the dielectric material of the top surface layer, are trimmed (removed) from the multilayer substrate 30. For trimming, for example, a cutting machine or a laser, which wave length is a fundamental harmonic, second-harmonic, or third-harmonic of YAG, is preferably used. The use of the laser can achieve fast and accurate processing. The trimming may be efficiently performed on the multilayer substrates 30 in a motherboard state.

In this manner, since the capacitor electrodes 71*a*, 72*a*, and 73*a*, which are adjacent to the upper surface of the multilayer substrate 30, act as capacitor electrodes for trimming, the thickness of the dielectric layer to be removed by the trimming can be minimized. In addition, since the number of electrodes that obstruct trimming is reduced (only the ports P1 to P3 and the connecting electrodes 31 to 33 in the case of the first preferred embodiment), a capacitor electrode region that allows for trimming is increased, so that a capacitance-adjustable region can be increased.

Since the terminating resistor 27 is also built into the multilayer substrate 30, trimming the terminating resistor 27, as well as the matching capacitors 71 to 73, together with the dielectric material of the top surface layer can adjust a resistance R. When the width of even one portion of the terminating resistor 27 is reduced, the resistance R increases. Thus, the trimming is performed up to a halfway point in the width direction.

The above-described components are preferably assembled as follows. As shown in FIG. 1, the permanent magnet 9 is secured to the ceiling of the upper metal casing 4 with an adhesive. The ends 21*a*, 22*a*, 23*a* of the center electrodes 21 to 23 of the center-electrode assembly 13 are soldered to the ports P1, P2, and P3 provided at the surface of the multilayer substrate 30 and the other ends 21*b*, 22*b*, 23*b* of the center electrodes 21 to 23 are soldered to the center-electrode connecting electrodes 31 to 33, thereby mounting the center-electrode assembly 13 on the multilayer substrate 30. Also, the center electrodes 21 to 23 may be effectively soldered to the multilayer substrates 30 in a motherboard state.

The multilayer substrate 30 is placed on the bottom portion 8*a* of the lower metal casing 8, and the ground electrode 74 provided at the lower surface of the multilayer substrate 30 is connected and fixed to the bottom portion 8*a* by soldering. This facilitates the ground external terminal 16 to be electrically connected to the terminating resistor 27, the series inductor 28, and the capacitor electrodes 58*a* and 58*b* via the side-surface via holes 65.

The lower metal casing 8 and the upper metal casing 4 are joined into a single metal casing by, for example, soldering the corresponding lateral portions 8*b* and 4*b*, and this metal casing also functions as a yoke. That is, this metal casing defines a magnetic path that surrounds the permanent magnet 9, the center-electrode assembly 13, and the multilayer substrate 30. The permanent magnet 9 also applies a direct-current magnetic field to the ferrite element 20.

Figure 3:
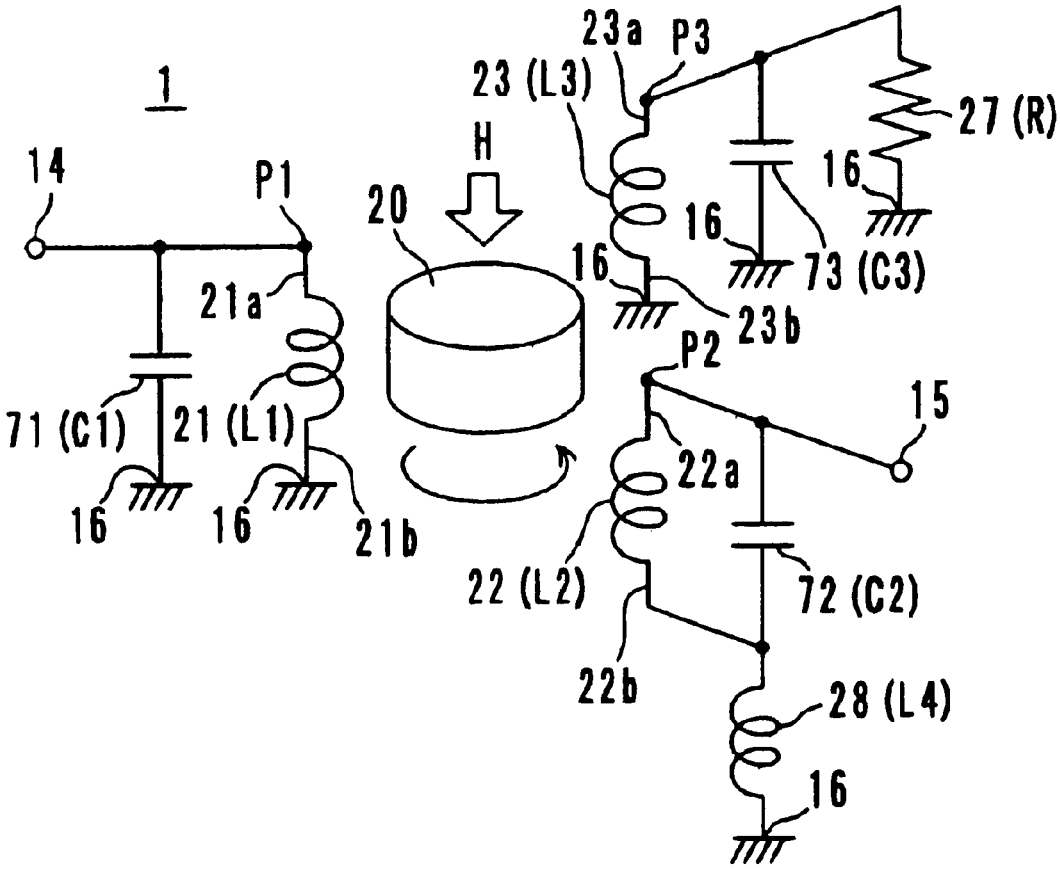
FIG. 3 is an electrical equivalent circuit diagram of the three-port isolator shown in FIG. 1.
Figure 4:
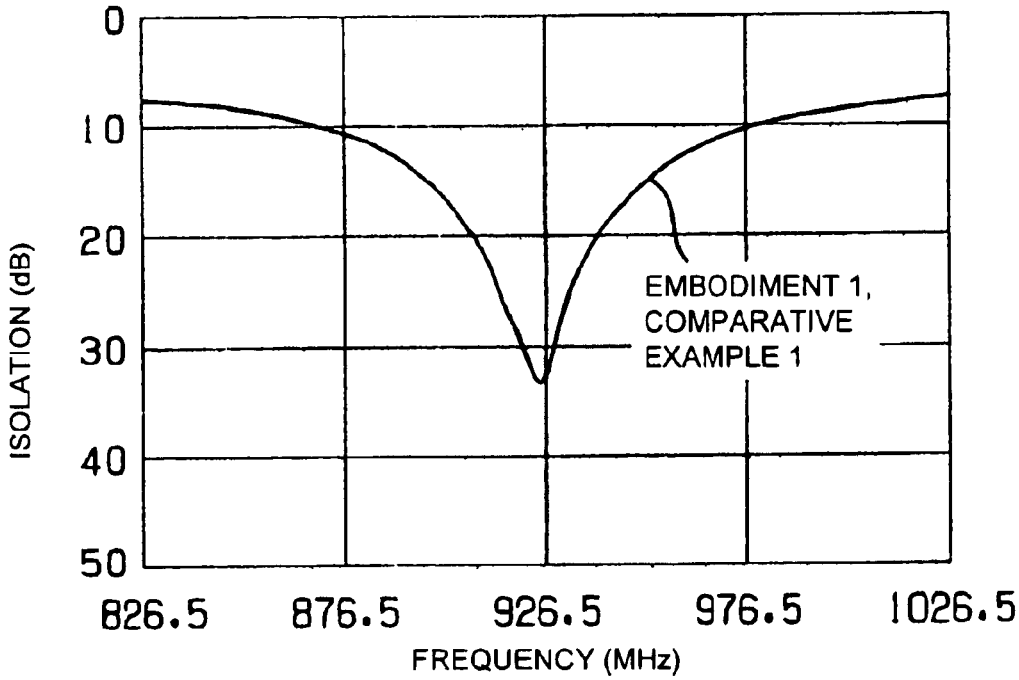
FIG. 4 is a graph showing isolation characteristics.
Figure 5:
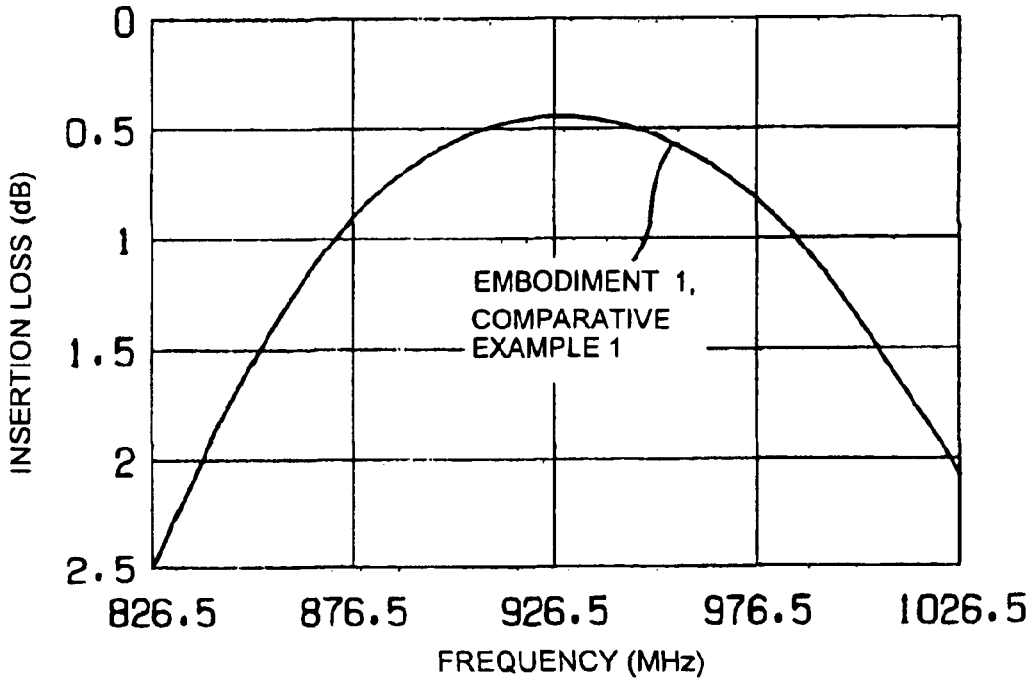
FIG. 5 is a graph showing insertion loss characteristics.
Figure 6:
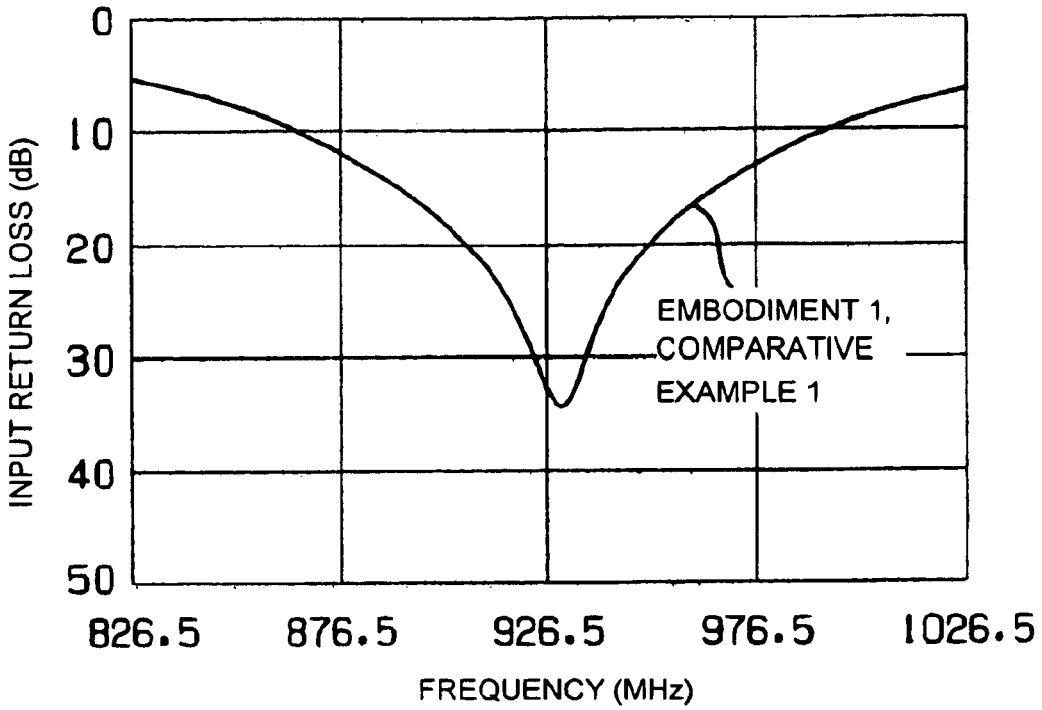
FIG. 6 is a graph showing input return-loss characteristics.
Figure 7:
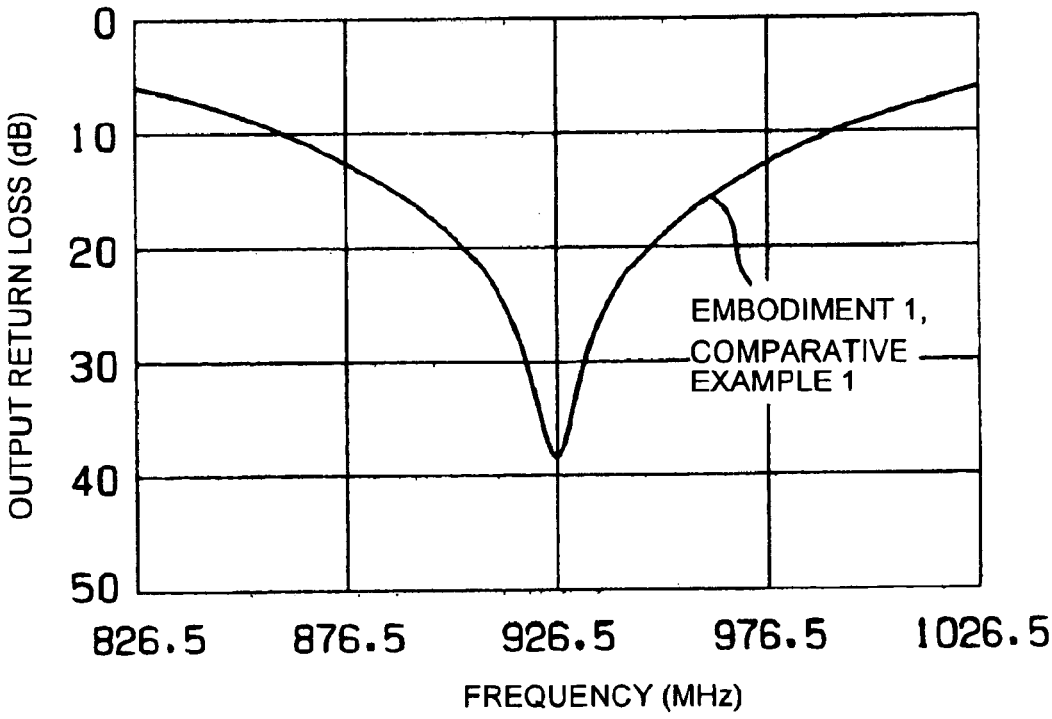
FIG. 7 is a graph showing output return-loss characteristics.
Figure 8:
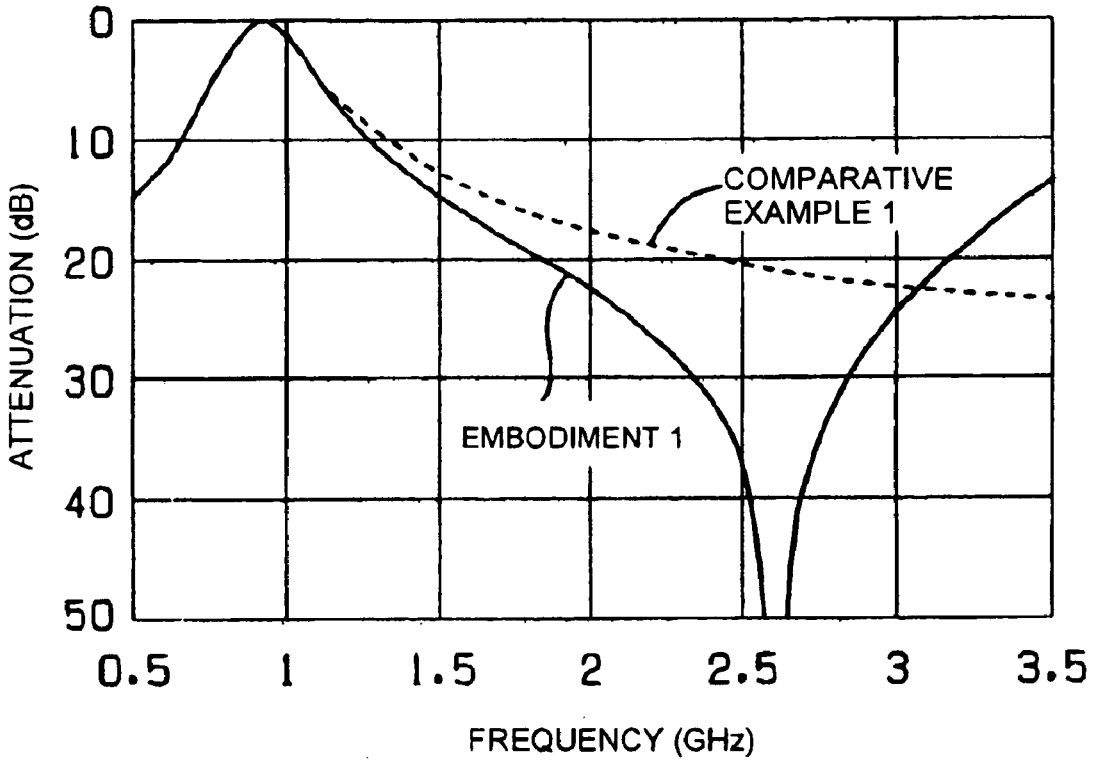
FIG. 8 is a graph showing attenuation characteristics.

In this manner, the three-port isolator 1 is provided. FIG. 3 is an electrical equivalent circuit diagram of the isolator 1. The one end 21*a* of the first center electrode 21 is electrically connected to the input external terminal 14 via the input port P1. The other end 21*b* of the first center electrode 21 is electrically connected to the corresponding ground external terminal 16 via the center-electrode connecting electrode 31. The matching capacitor 71 is electrically connected between the input external terminal 14 and the corresponding ground external electrode 16.

The one end 22*a* of the second center electrode 22 is electrically connected to the output external terminal 15 via the output port P2. The second center electrode 22 and the matching capacitor 72 constitute an LC parallel resonator circuit. The series inductor 28 is electrically connected between the LC parallel resonator circuit and the corresponding ground external terminal 16.

The one end 23*a* of the third center electrode 23 is electrically connected to the third port P3. The other end 23*b* of the third center electrode 23 is electrically connected to the corresponding ground external terminals 16 via the center-electrode connecting electrode 33. The matching capacitor 73 and the terminating resistor 27 constitute a parallel RC circuit, which is electrically connected between the third port P3 and ground. That is, the other ends 21*b* and 23*b* of the first and third center electrodes 21 and 23 are electrically connected to the corresponding ground external terminal 16 and are at a common potential. The other end 22*b* of the second center electrode 22 is electrically connected to the corresponding ground external terminal 16 via the series inductor 28. The end 22*b* is not at a potential common to that of the ends 21*b* and 23*b*, and thus does not share a common end therewith.

In the three-port isolator 1 having the above-described configuration, the LC parallel resonator circuit, which is constituted by the center electrode 22 and the matching capacitor 72, is connected to the series inductor 28 between the output port P2 and ground. The LC parallel resonator circuit and the series inductor 28 constitute a trap circuit, whose resonant frequency (trap frequency) is in the range of about 1.5 to about 3.5 times the operating frequency f. This trap circuit prevents the insertion loss characteristic and the return loss characteristic from deteriorating, thereby allowing an increase in the attenuations of the second harmonic (2 f) and the third harmonic (3 f) of the operating frequency f of a communication apparatus.

Figure 12:
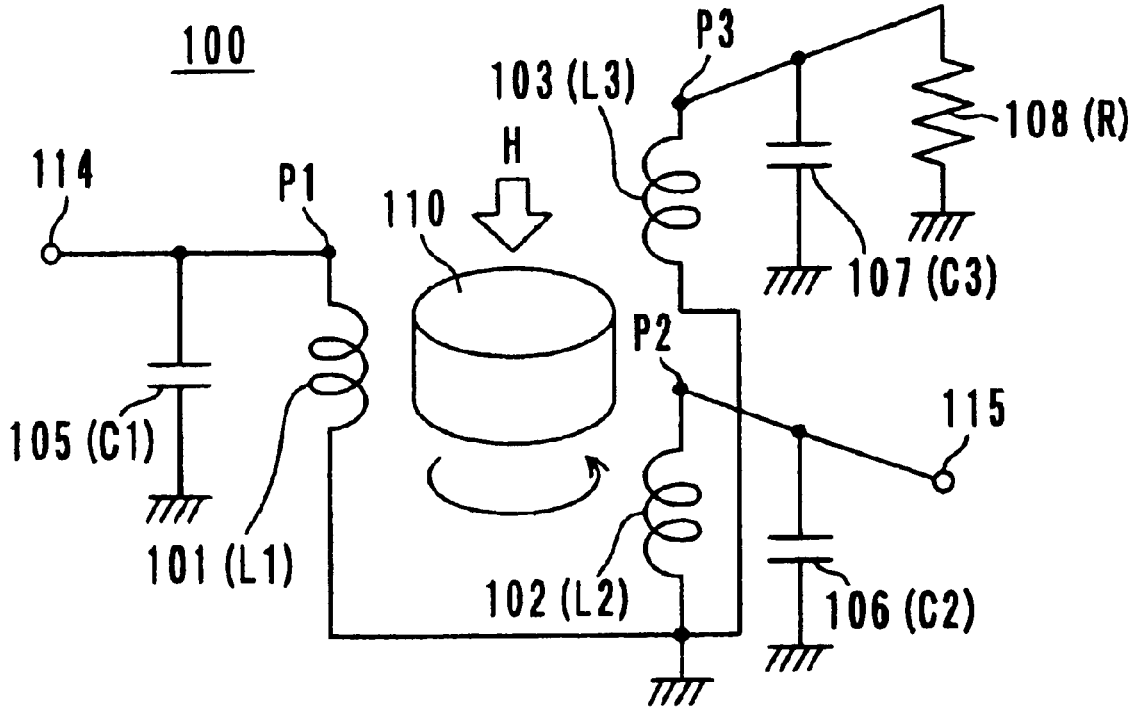
FIG. 12 PRIOR ART
FIG. 12 is an electrical equivalent circuit diagram of a conventional three-port isolator.

FIGS. 4, 5, 6, 7, and 8 are graphs showing the isolation characteristic, insertion loss characteristic, input return-loss characteristic, output return-loss characteristic, and attenuation characteristic, respectively, of the three-port isolator 1 of the first preferred embodiment (see the solid lines denoted with Embodiment 1). For comparison, in FIGS. 4 to 8, the corresponding characteristics of the conventional three-port isolator 100 illustrated in FIG. 12 are also plotted (see the dotted line denoted with Comparative Example 1). Table 1—shows numeric values of the inductances L1, L2, and L3 of the first to third center electrodes, the capacitances C1, C2, and C3 of the matching capacitors, and the inductances L4 of the inductors of the third-port isolator 1 of the first preferred embodiment (Embodiment 1), the conventional three-port isolator 100 (Comparative Example 1) shown in FIG. 12, and the conventional three-port isolator 120 (Comparative Example 2) shown in FIG. 13.

The resistance R of each terminating resistor is about 65 Ω. The inductances of the center electrodes in Table 1—1 are practically the self-inductances of the center electrodes when the relative magnetic permeability is assumed to be 1. In practice, the inductances L1, L2, and L3 are given by multiplying the corresponding self-inductances by an effective magnetic permeability of the ferrite or the like.

TABLE 1-1

| | Self-inductance of Center Electrodes 21 & 22 | Self-inductance of Center Electrode 23 | C1 | C2 | C3 | L4 |
|---|---|---|---|---|---|---|
| Comparative Example 1 | 1.0 nH | 0.7 nH | 0.4 pF | 10.4 pF | 15.0 pF | — |
| Comparative Example 2 | 1.0 nH | 0.7 nH | 10.4 pF | 9.1 pF | 15.0 pF | 0.4 nH |
| Embodiment 1 | 1.0 nH | 0.7 nH | 10.4 pF | 10.4 pF | 15.0 pF | 0.4 nH |

TABLE 1-2

| | Input Return Loss (dB) | Insertion Loss (dB) | Isolation (dB) | Output Return Loss (dB) | Attenuation of Second Harmonic (dB) | Attenuation of Third Harmonic (dB) |
|---|---|---|---|---|---|---|
| Comparative Example 1 | 15.2 | 0.66 | 12.8 | 15.7 | 16.0 | 21.0 |
| Comparative Example 2 | 15.1 | 0.69 | 12.8 | 15.3 | 19.5 | 31.0 |
| Embodiment 1 | 15.2 | 0.66 | 12.8 | 15.8 | 19.1 | 29.1 |

Figure 13:
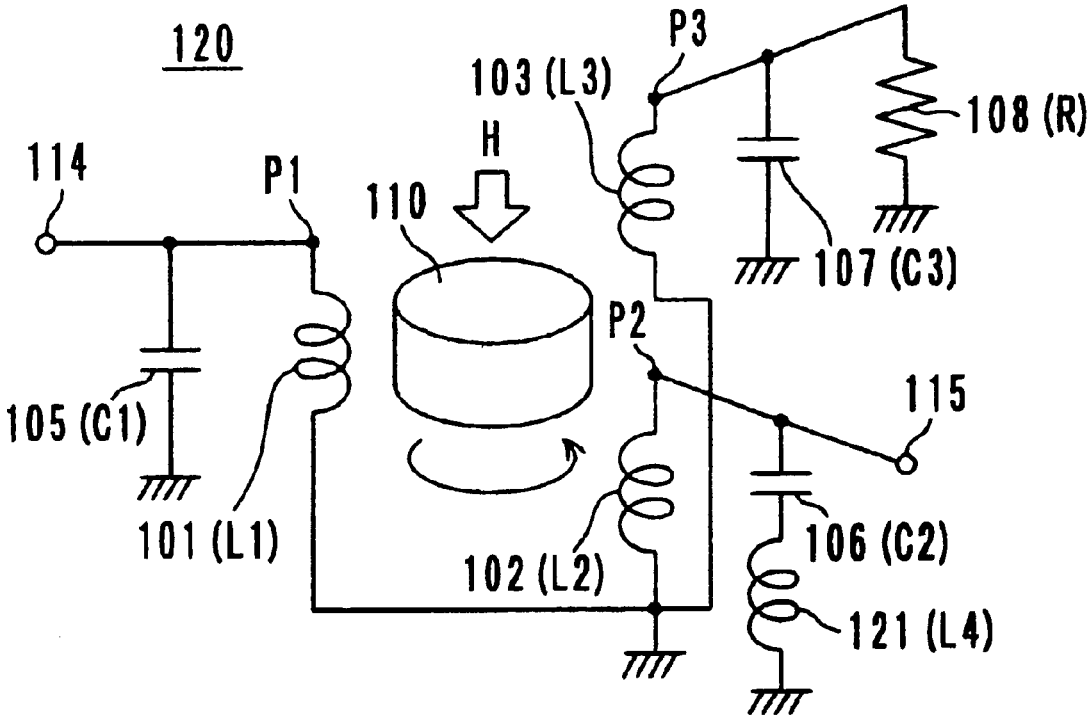
FIG. 13 PRIOR ART
FIG. 13 is an electrical equivalent circuit diagram of another conventional three-port isolator.
Figure 14:
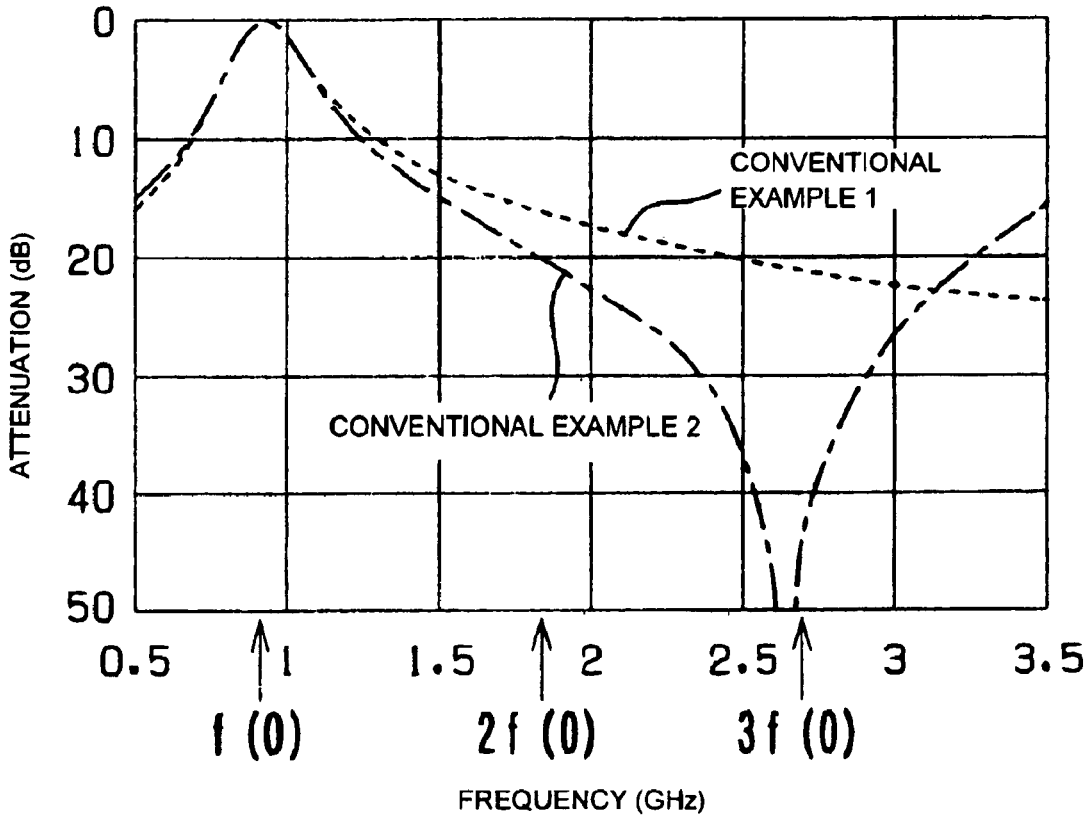
FIG. 14 PRIOR ART
FIG. 14 is a graph showing attenuation characteristics.
Figure 15:
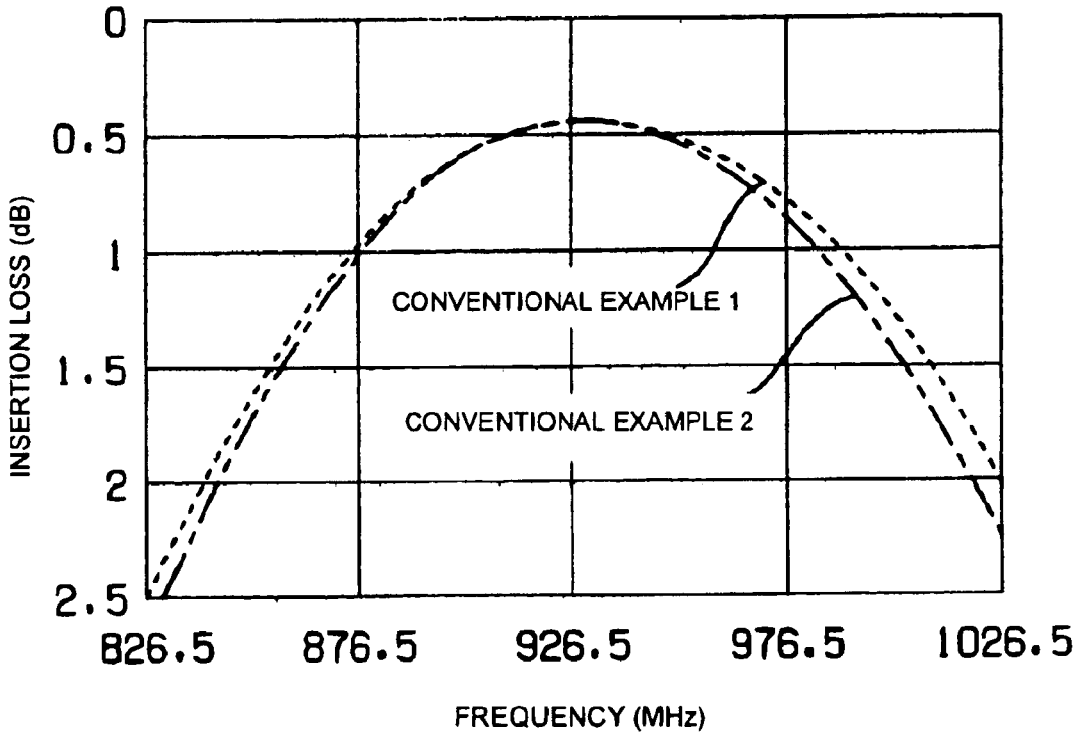
FIG. 15 PRIOR ART
FIG. 15 is a graph showing insertion loss characteristics.
Figure 16:
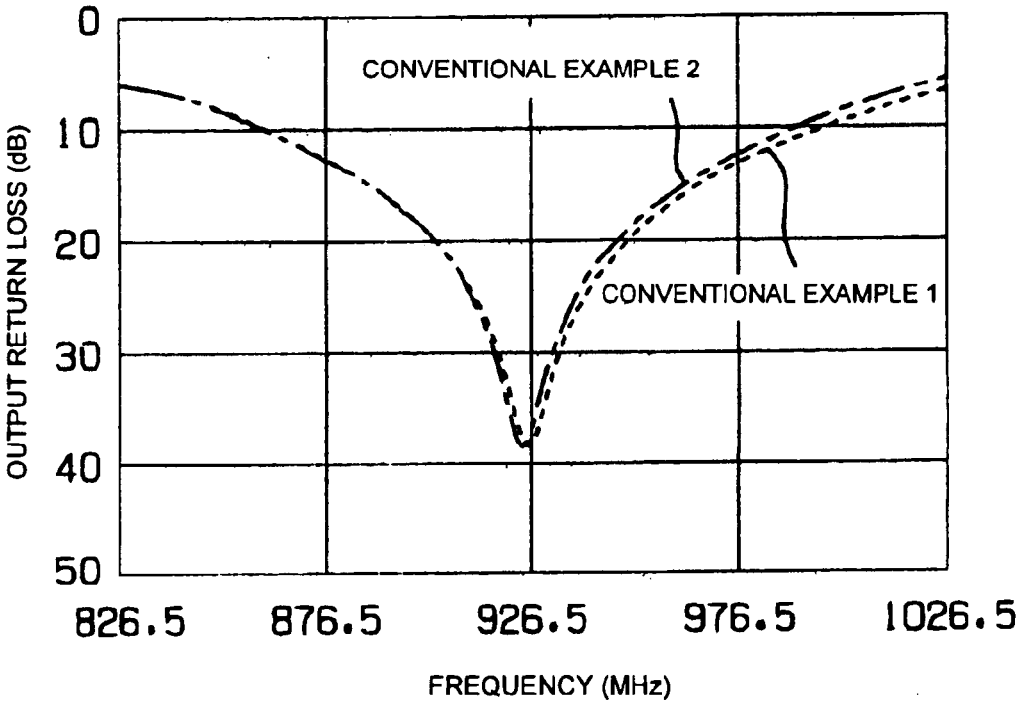
FIG. 16 PRIOR ART
FIG. 16 is a graph showing output return-loss characteristics.

The admittance Y and the resonant frequency f(0) of the trap circuit that is constituted by the matching capacitor 106 and the inductor 121 of the conventional three-port isolator 120 (Comparative Example 2) shown in FIG. 13 are given by the following expressions (1) and (2).

$$Y=(\omega C2)/j(\omega^2 L4C2-1),\ \omega=2\pi f \tag{1}$$

$$f(0)=1/\{2\pi(L4C2)^{1/2}\} \tag{2}$$

In Comparative Example 2, from Expression (1) noted above, the admittance Y of the series resonator circuit of the 9.1 pF matching capacitor 106 and the 0.4 nH inductor 121 is substantially equal to the admittance of the 10.4 pF capacitor in the band of 893 MHz to 960 MHz. From Expression (2) noted above, the resonant frequency f(0) of the series resonator circuit becomes substantially 2.7 GHz.

Meanwhile, the impedance Z and the resonant frequency f(0) of the trap circuit constituted by the center electrode 22, the matching capacitor 72, and the series inductor 28 of the three-port isolator 1 (Embodiment 1) of the first preferred embodiment can be represented by Expression (3) and (4) as follows:

$$Z=j\{\omega L4-\omega L2/(\omega^2 L2C2-1)\} \tag{3}$$

$$\begin{aligned} f(0) &= 1/2\pi\cdot[\{(L2/L4)+1\}/(L2C2)]^{1/2} \\ &= 1/2\pi\cdot[1/C2\cdot\{(1/L2)+(1/L4)\}]^{1/2} \end{aligned} \tag{4}$$

Thus, for example, when the effective magnetic permeability is assumed to be 2, the resonant frequency of the trap circuit becomes about 2.7 GHz from Equation (4) by using the numeric values of the self-inductance of the center electrode 22, the capacitance C2 of the matching capacitor 72, and the inductance L4 of the series inductor 28 as shown in Table 1—1. In this case, the inductance L2 is a value obtained by multiplying the self-inductance of the second center electrode 22 by the effective magnetic permeability of 2.

Table 1–2 summarizes the worst values in the operating frequency band of 893 MHz to 960 MHz, the attenuations of second harmonics (1786 MHz to 1920 MHz), and the attenuations of third harmonics (2679 MHz to 2880 MHz) of the three-port isolators 1, 100, and 120 of Embodiment 1 and Comparative Examples 1 and 2.

Since the matching capacitors 71 to 73 and the series inductor 28 are built into the semiconductor substrate 30, the number of connections soldered between the matching capacitors 71 to 73 and the series inductor 28 can be reduced, thereby allowing an improvement in the connection reliability of the isolator 1. In addition, the component count and manufacturing man-hours can be reduced, thereby allowing a reduction in the cost of the isolator 1.

Second Preferred Embodiment

Figure 9:
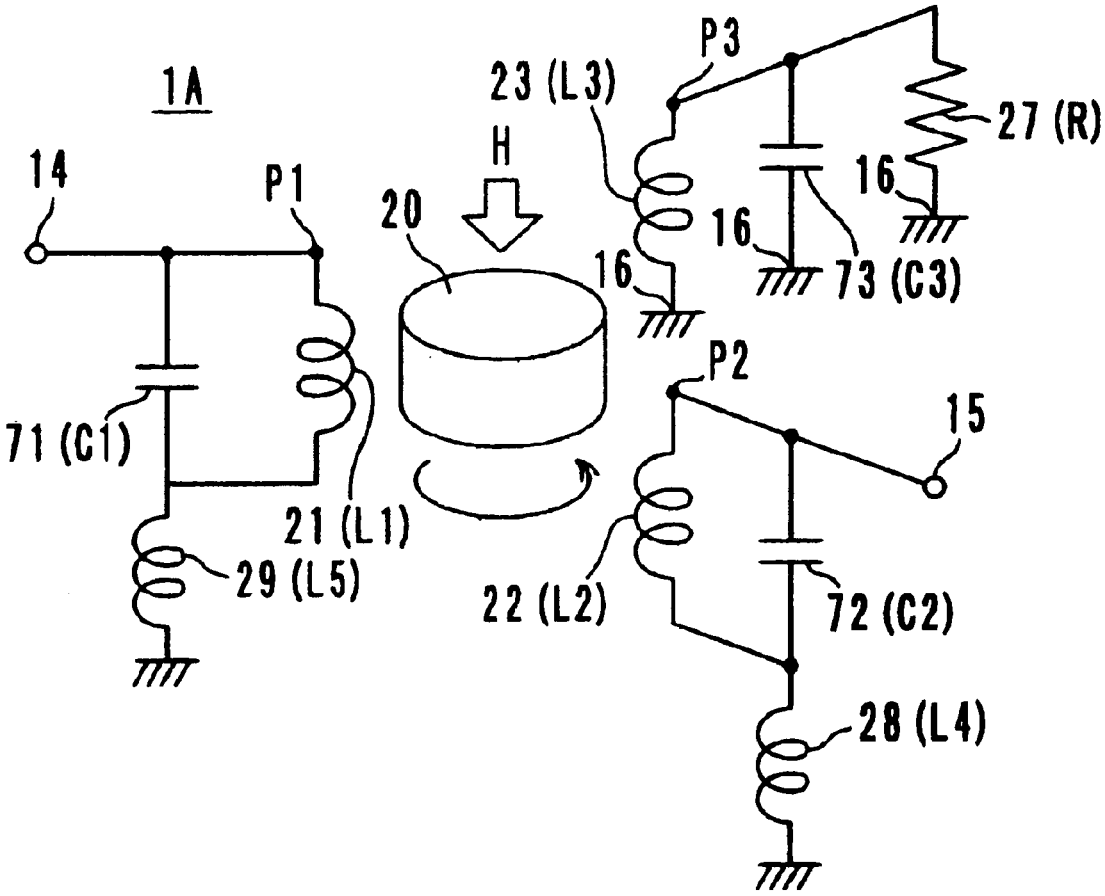
FIG. 9 is an electrical equivalent circuit diagram showing a three-port isolator according to a second preferred embodiment of the present invention.
Figure 10:
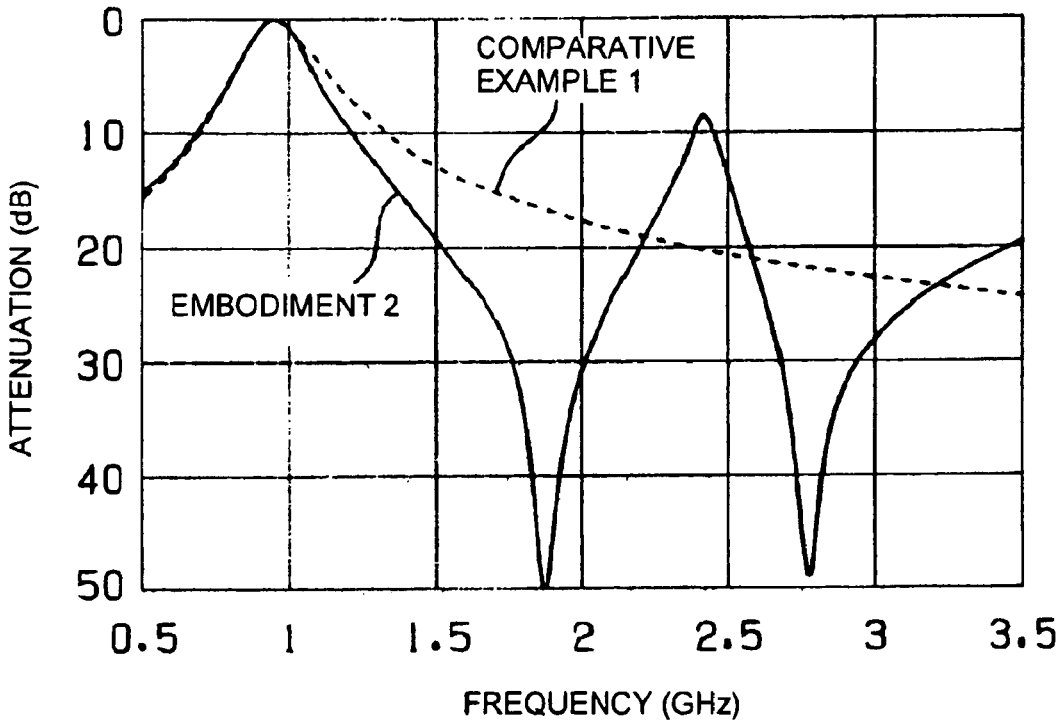
FIG. 10 is a graph showing attenuation characteristics.

A second preferred embodiment of the present invention will now be described with reference to FIGS. 9 and 10. As shown in FIG. 9, a three-port isolator 1A according to a second preferred embodiment has a configuration in which another series inductor 29 is electrically connected to the LC parallel resonator circuit constituted by the input-side center electrode 21 and the matching capacitor 71 in the three port isolator 1 of the first preferred embodiment. The series inductor 29 is arranged inside the multilayer substrate 30 as in the case of the series inductor 28. The end 23*b* of the third center electrode 23 is electrically connected to the corresponding ground external terminal 16. On the other hand, the ends 21*b* and 22*b* of the first center electrode 21 and the second center electrode 22 are electrically connected to the ground external terminals 16 via the corresponding series inductors 29 and 28. All of the ends 21*b*, 22*b*, and 23*b* are not at a common potential and do not share a common end.

The inductance L4 of the series inductor 28 is set so that the resonant frequency (trap frequency) of the trap circuit constituted by the center electrode 22, the matching capacitor 72, and the series inductor 28 is in the vicinity of the third harmonic (3 f). The inductance L5 of the series inductor 29 is also set so that the resonant frequency (trap frequency) of the trap circuit constituted by the center electrode 21, the matching capacitor 71, and the series inductor 29 is in the vicinity of the second harmonic (2 f).

In the second preferred embodiment, the inductance L4 is preferably about 0.8 nH and the inductance L5 is preferably about 0.3 nH. As a result, the attenuation of the second harmonic (2 f) becomes about 33.8 dB and the attenuation of the third harmonic (3 f) becomes 29.2 dB. Thus, the second preferred embodiment can improve the attenuation compared to the isolator 1 of the first preferred embodiment. FIG. 10 is a graph showing the attenuation characteristic of the three-port isolator 1A (see the solid line denoted with Embodiment 2). For comparison, in FIG. 10, the attenuation characteristic of the conventional three-port isolator 100 illustrated in FIG. 12 is also plotted (see the dotted line denoted with Comparative Example 1).

Third Preferred Embodiment

A third preferred embodiment of the present invention will now be described with reference to FIG. 11. The third preferred embodiment is directed to a communication apparatus according to the present invention and will be described in the context of a portable telephone by way of example.

Figure 11:
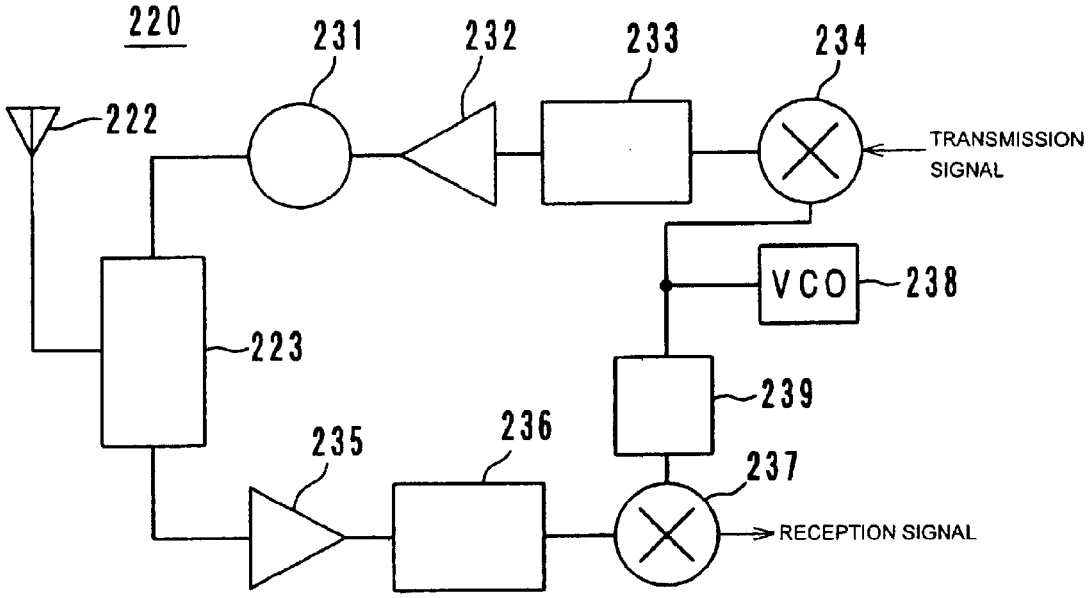
FIG. 11 is an electrical circuit block diagram of a communication apparatus according to a preferred embodiment the present invention.

FIG. 11 is an electrical circuit block diagram of an RF section of a portable telephone 220. In FIG. 11, reference numeral 222 indicates an antenna element, 223 is a duplexer, 231 is a sending-side isolator, 232 is a sending-side amplifier, 233 is a sending-side interstage bandpass filter, 234 is a sending-side mixer, 235 is a receiving-side amplifier, 236 is a receiving-side interstage bandpass filter,

237 is a receiving-side mixer, 238 is a voltage controlled oscillator (VCO), and 239 is a local bandpass filter.

In this case, one of the three-port isolators 1 and 1A of the first and second preferred embodiments can be used as the sending-side isolator 231. Incorporating the isolator of various preferred embodiments of the present invention can achieve a portable telephone having improved frequency characteristics and enhanced reliability.

Other Preferred Embodiments

The present invention is not limited to the illustrated preferred embodiments and various modifications can be made thereto within the sprit and scope of the present invention. For example, the north pole and the south pole of the permanent magnet 9 may be reversed so that the input port P1 and the output port P2 are interchanged. Also, although the inductor 28 is preferably built into the multilayer substrate, the inductor 28 may be formed as an inductor chip or an air-core coil. In addition, the matching capacitors 71 to 73 may be formed as a single-plate capacitor.

The ends 21*b*, 22*b*, and 23*b* of the first, second, and third center electrodes 21, 22, and 23 may be electrically connected to the ground external terminals 16 via respective series inductors. In such a case, all of the ends 21*b*, 22*b*, and 23*b* are not at a common potential and do not share a common end.

The present invention is not limited to each of the above-described preferred embodiments, and various modifications are possible within the range described in the claims. An embodiment obtained by appropriately combining technical means disclosed in each of the different preferred embodiments is included in the technical scope of the present invention.

What is claimed is:

1. A three-port nonreciprocal circuit device, comprising:

a ferrite element;

a permanent magnet for applying a direct-current magnetic field to the ferrite element;

a first center electrode arranged at a major surface of the ferrite element or in the ferrite element, one end of the first center electrode being electrically connected to a first port;

a second center electrode arranged at the major surface of the ferrite element or in the ferrite element so as to cross the first center electrode in an electrically insulated state, one end of the second center electrode being electrically connected to a second port;

a third center electrode arranged at the major surface of the ferrite element or in the ferrite element so as to cross the first center electrode and the second center electrode in an electrically insulated state, one end of the third center electrode being electrically connected to a third port;

at least one matching capacitor constituting at least one LC parallel resonator circuit in conjunction with one of the first, second, and third center electrodes; and at least one series inductor electrically connected between at least one of the at least one LC parallel resonator circuit and ground; wherein the other end of at least one of the first, second, and third center electrodes is not connected to a common potential and does not share a common end with the other end of a different center electrode.

2. The three-port nonreciprocal circuit device according to claim 1, further comprising at least two matching capacitors and a plurality of series inductors, wherein the series inductors have inductances that are different from each other.

3. The three-port nonreciprocal circuit device according to claim 1, wherein the at least one matching capacitor includes a capacitor electrode and the at least one series inductor includes an inductor electrode, the capacitor electrode and the inductor electrode being provided in a multilayer substrate in which insulating layers are stacked.

4. The three-port nonreciprocal circuit device according to claim 1, wherein the at least one LC parallel resonator circuit and the corresponding series inductor constitute a circuit that has a resonant frequency in the range of about 1.5 to about 3.5 times an operating frequency of the three-port nonreciprocal circuit device.

5. A communication apparatus comprising the three-port nonreciprocal circuit device according claim 1.

6. A three-port nonreciprocal circuit device for use as an isolator, comprising:

a ferrite element;

a permanent magnet for applying a direct-current magnetic field to the ferrite element;

a first center electrode arranged at a major surface of the ferrite element or in the ferrite element, one end of the first center electrode being electrically connected to a first port;

a second center electrode arranged at the major surface of the ferrite element or in the ferrite element so as to cross the first center electrode in an electrically insulated state, one end of the second center electrode being electrically connected to a second port;

a third center electrode arranged at the major surface of the ferrite element or in the ferrite element so as to cross the first center electrode and the second center electrode in an electrically insulated state, one end of the third center electrode being electrically connected to a third port;

an input terminal electrically connected to the first port;

an output terminal electrically connected to the second port;

a terminating resistor electrically connected to the third port;

at least one matching capacitor constituting at least one LC parallel resonator circuit in conjunction with one of the first and second center electrodes; and at least one series inductor electrically connected between one of the at least one LC parallel resonator circuit and ground; wherein the other end of at least one of the first, second, and third center electrodes is not connected to a common potential and does not a share a common end with the other end of a different center electrode.

7. The three-port nonreciprocal circuit device according to claim 6, wherein the at least one matching capacitor includes a capacitor electrode and the at least one series inductor includes an inductor electrode, the capacitor electrode and the inductor electrode being provided in a multilayer substrate in which insulating layers are stacked.

8. The three-port nonreciprocal circuit device according to claim 6, wherein the at least one LC parallel resonator circuit and the corresponding series inductor constitute a circuit that has a resonant frequency in the range of about 1.5 to about 3.5 times an operating frequency of the three-port nonreciprocal circuit device.

9. A communication apparatus comprising the three-port nonreciprocal circuit device according to claim 6.

* * * * *